US007382099B2

(12) United States Patent
Chen et al.

(10) Patent No.: US 7,382,099 B2
(45) Date of Patent: Jun. 3, 2008

(54) STRIATION CONTROL FOR CURRENT FED ELECTRONIC BALLAST

(75) Inventors: Timothy Chen, Aurora, OH (US); Timothy B. Gurin, Munson Township, OH (US); James D. Mieskoski, Seven Hills, OH (US); James K. Skully, Willoughby, OH (US)

(73) Assignee: General Electric Company, Schenectady, NY (US)

( * ) Notice: Subject to any disclaimer, the term of this patent is extended or adjusted under 35 U.S.C. 154(b) by 115 days.

(21) Appl. No.: 10/987,473

(22) Filed: Nov. 12, 2004

(65) Prior Publication Data

US 2006/0103328 A1 May 18, 2006

(51) Int. Cl.
*H05B 37/02* (2006.01)

(52) U.S. Cl. ..... 315/291; 315/209 R; 315/244; 315/276

(58) Field of Classification Search ..... 315/276, 315/291, 224–225, 244, 209 R, 219, 246–247, 315/307

See application file for complete search history.

(56) References Cited

U.S. PATENT DOCUMENTS 3,440,488 A * 4/1969 Skirvin ..... 315/209 R
4,143,315 A * 3/1979 Kelley, Jr. ..... 323/210
4,245,177 A * 1/1981 Schmitz ..... 315/209 R
4,469,988 A * 9/1984 Cronin ..... 315/209 R
4,682,082 A 7/1987 Macaskill et al. ..... 315/219
4,700,113 A * 10/1987 Stupp et al. ..... 315/224
4,999,547 A * 3/1991 Ottenstein ..... 315/307
5,001,386 A 3/1991 Sullivan et al. ..... 315/219
5,369,339 A 11/1994 Reijnaerts ..... 315/209
5,440,207 A * 8/1995 Otsuka ..... 315/149
5,477,112 A * 12/1995 Lesea ..... 315/209 R
5,701,059 A 12/1997 Steigerwald et al. ..... 315/219
5,821,699 A * 10/1998 Moisin ..... 315/291
5,834,903 A * 11/1998 Christian ..... 315/219
5,923,550 A * 7/1999 Kumar ..... 363/69
5,945,788 A * 8/1999 Li et al. ..... 315/308
5,955,841 A * 9/1999 Moisin et al. ..... 315/56
6,069,453 A 5/2000 Arts et al. ..... 315/209
6,114,814 A * 9/2000 Shannon et al. ..... 315/219
6,326,740 B1 * 12/2001 Chang et al. ..... 315/291
6,465,972 B1 * 10/2002 Kachmarik et al. ..... 315/209 R
6,756,747 B2 * 6/2004 Hsieh ..... 315/291
6,836,077 B2 * 12/2004 Nerone ..... 315/209 R
2002/0017881 A1 * 2/2002 Szabados ..... 315/312
2003/0015970 A1 * 1/2003 Nerone ..... 315/291
2004/0085031 A1 * 5/2004 Hsieh ..... 315/291
2004/0160248 A1 * 8/2004 Streit ..... 327/129
2005/0248295 A1 * 11/2005 Chiou ..... 315/247

* cited by examiner

OTHER PUBLICATIONS

European Search Report, Application No. EP 05 25 6816; Completed Jan. 12, 2006; Munich.

*Primary Examiner*—Thuy Vinh Tran
*Assistant Examiner*—Tung X Le
(74) *Attorney, Agent, or Firm*—Fay Sharpe LLP

(57) ABSTRACT

In a lamp lighting ballast which generates a lamp lighting signal for a lamp, provided is a striation elimination circuit to increase the lumen output frequency for elimination of visual striations which may occur within the lamp. An even harmonic signal generator is configured to generate an even harmonic waveform, and an injection point is configured to receive the even harmonic signal into the lamp lighting system. The injection point is located at a location wherein the even harmonic signal alters the lamp lighting signal from a symmetric signal configuration to a high content even harmonic signal configuration prior to being received by the lamp.

21 Claims, 7 Drawing Sheets

STRIATION CONTROL FOR CURRENT FED ELECTRONIC BALLAST

BACKGROUND

The present application is directed to improving the visual appearance of gas discharge lamps, and more particularly, to the elimination of visual striations which may occur in gas discharge lamps.

Generally, a gas discharge lamp will have an elongated gas-filled tube having electrodes at each end. A voltage between the electrodes accelerates movement of electrons. This causes the electrons to collide with gas atoms producing positive ions and additional electrons forming a gas plasma of positive and negative charge carriers. Electrons continue to stream toward the lamp's anode electrode and the positive ions toward its cathode electrode sustaining an electric discharge in the tube and further heating the electrodes. The electric discharge causes an emission of radiation having a wavelength dependent on the particular fill gas and the electrical parameters of the discharge.

A fluorescent lamp is a gas discharge lamp in which the inner surface of the tube is coated with a fluorescent phosphor. The phosphor is excited by the ultraviolet radiation from the electric discharge and fluoresces, providing visible light.

During operation of a gas discharge lamp, such as a fluorescent lamp, a phenomenon known as striations can occur. Striations are zones of light intensity, appearing as dark bands. This phenomenon can give a lamp an undesirable strobing effect. An example of the striation phenomenon is shown in FIG. 1, which depicts a linear fluorescent lamp 10. In one embodiment lamp 10 may employ Krypton (Kr) as a buffer gas to improve the efficacy of the lamp. In FIG. 1, lamp 10 has striation zones 12 which appear as the dark bands moving along the length of the lamp.

A variety of theories as to why striations occur have been set forth. For example, in U.S. Pat. No. 5,001,386 to Sullivan, it is stated that striations are believed to occur as a result of high-frequency currents re-enforcing a standing wave of varying charge distribution between the lamp electrodes.

Sullivan attempts to solve the striation problem by injecting a dc component superimposed on top of a driving ac current. A disadvantage to this technique, is the requirement that existing typical high-frequency ballasts in the marketplace must be removed and replaced with a unique ballast capable of injecting the dc bias component. Also, adding the dc bias may damage the lamp, by moving mercury in the lamp to one end, creating an unbalanced light output. It is also suggested that increasing the crest factor in a lamp lighting system will eliminate the visual striations. However, increasing the crest factor may also increase the stress on a lamp, which will lead to a shorter lamp life.

Another alternative was proposed by Kachmarik et al., U.S. Pat. No. 6,465,972 ('972) which provides an amplitude modulation circuit placed in operative connection with the lamp input line. The amplitude modulation circuit is configured to periodically modulate amplitudes of the lamp input signal prior to the lamp input signal being received by the gas discharge lamp. Operation of the amplitude modulation circuit results in a periodic amplitude modulation of the lamp current to eliminate visual striations otherwise occurring in the lamp.

Yet a further attempt to eliminate striations is proposed in U.S. application Ser. No. 09/681,994 (U.S. Publication No. 2003-0015970A1) to Nerone. In this application a ballast is designed to convert an AC system power source to a DC voltage on a DC bus included within the ballast circuit. An inverter circuit is provided in the ballast circuit in operative connection with the DC bus to generate an asymmetric alternating current on a lamp input line. A gas discharge lamp is in operative connection to the lamp input line, configured to receive an asymmetric alternating current, thereby eliminating visual striations occurring in the lamp.

BRIEF SUMMARY

In a lamp lighting system which generates a lamp lighting signal to energize a lamp of the system, provided is a striation elimination circuit for elimination of visual striations which may occur within the lamp. An even harmonic signal generator is configured to generate an even harmonic waveform, and an injection point is configured to receive the even harmonic signal into the lamp lighting system. The injection point is located at a location wherein injection of the even harmonics signal alters the lamp lighting signal from a waveform with no or a low content of even harmonics signal to an even harmonic rich signal prior to being received by the lamp.

DETAILED DESCRIPTION

Figure 1:
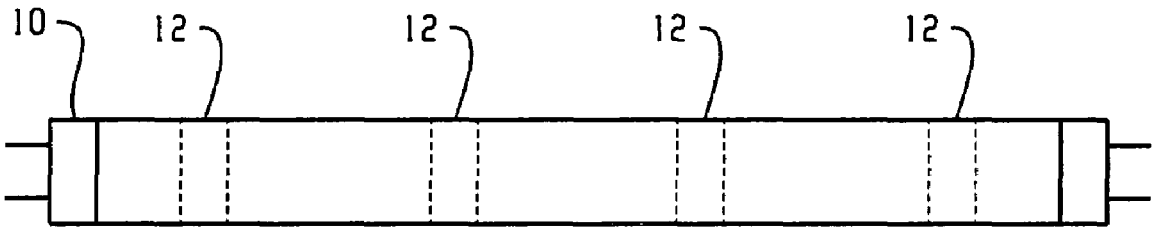
FIG. 1 illustrates a typical fluorescent lamp having striation zones creating a strobing effect to an end user.

As depicted in FIG. 1, striation zones 12 cause an undesirable visual effect to an end user. In addressing this problem, it was considered the striations occur due to the repetitiveness of the input signal supplied to the lamps, which reinforce a standing wave of varying charge distribution between the lamp and electrodes.

Previous attempts to limit striations as described in the Background, commonly addressed striations which occurred during a dimming of a lamp. However, striations are now occurring when lamps are being operated at high or 100% output power and while at room temperature. A primary cause of striations occurring in these situations is due to the use of higher percentages of Krypton (Kr), which is employed as a buffer gas to improve the efficacy and usefulness of the lamps. For example, lamps may now have a content of approximately 40% to 70% or more of Krypton (Kr).

Therefore, the concepts of the present application are intended to address both striations which occur due to dimming, as well as when the lamp is not being dimmed. In addressing this matter, it has been determined that it is desirable to create a high even harmonics content with respect to the fundamental waveform, to increase the striation frequency above the range a human eye is able to detect the effect (striation). Typically, this frequency is greater than approximately 40 Hz. It is to be appreciated that, while the following description is beneficial for lamps having high Krypton content, it is also effective for lamps having other Krypton content percentages or other buffer gases, as well as for use with lamps which are being dimmed.

Figure 2:
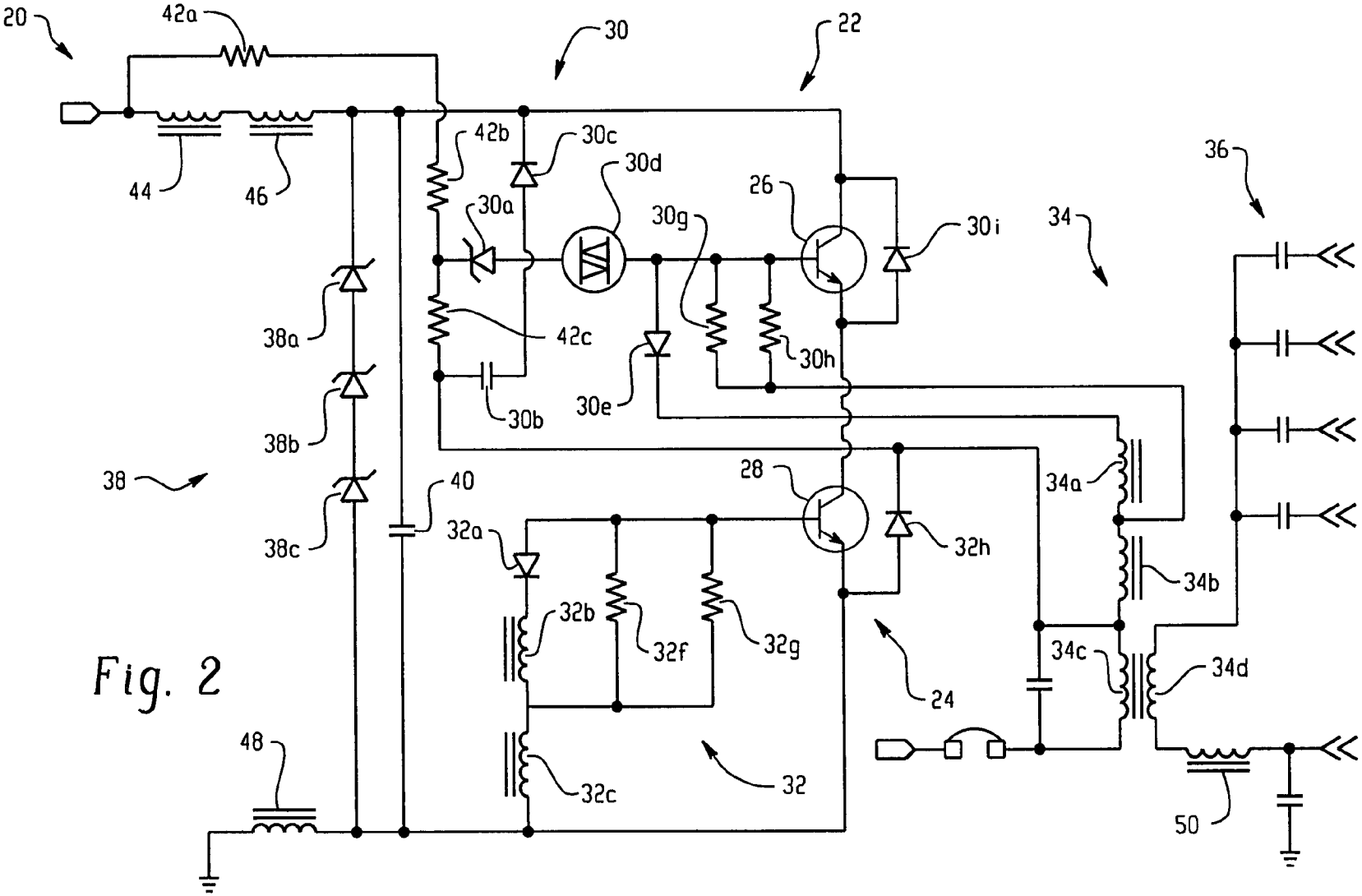
FIG. 2 illustrates a half-bridge current fed inverter ballast circuit incorporating the visual striation elimination circuit according to the present application.

Turning to FIG. 2, illustrated is a particular circuit in which the concepts of the present application may be employed. It is to be appreciated, however, the concepts described herein are not intended to be limited only to such a circuit, and may be employed in other lamp lighting control circuits. That having been said, FIG. 2 is a half-bridge current fed ballast 20 in which striation control is incorporated. The half-bridge current fed ballast 20 includes an upper switching configuration 22, and a lower switching configuration 24. These switching configurations include switches such as BJTs 26 and 28 respectively, driven by an upper BJT control network 30, and a lower BJT control network 32. Upper control network 30 includes zener diode 30*a*, capacitor 30*b*, diode 30*c*, diac 30*d*, diode 30*e*, resistors 30*g*, 30*h* and diode 30*i*. Lower control network 32 includes diode 32*a* transformer windings 32*b* and 32*c*, resistors 32*f* and 32*g*, and diode 32*h*. For a more detailed discussion regarding operation of these components, reference may be made to commonly assigned U.S. Ser. No. 10/667,545 entitled Voltage Controlled Start-Up Circuit for Electronic Ballast, filed Sep. 22, 2003, hereby incorporated by reference in its entirety.

An output transformer system 34, including base drive windings 34*a*, 34*b*, primary winding 34*c* and secondary winding 34*d*, provides output signals to lamp connectors 36. Additional protection and control circuitry such as transit network 38 including transits 38*a*, 38*b* and 38*c* and a voltage input network including resistors 42*a*, 42*b* and 42*c* are further provided in the circuit.

The half-bridge circuit 20 shown in FIG. 2 is designed as a current fed inverter ballast. A current fed transformer of the circuit comprised of windings 44, 46 and 48 is used to generate current for circuit operation. The present development employs a winding 50 coupled to the current fed transformer 44, 46, 48 to supply an even harmonics signal for the lamps. The even harmonics signal is injected into a secondary winding 34*d* of the output transformer 34 on the lamp side of the system, via coupled winding 50. The even harmonic signal is derived from the fundamental waveform of the signals generated by the switching operation of half-bridge circuit 20.

In one embodiment, it is noted the coupled winding signal can alternatively be injected into the primary side 34*c* of the output transformer 34. Thus, depicted is a striation control circuit which employs an even harmonic signal that is, in this embodiment, derived from the current transformer windings (current fed chokes) 44, 46 and 48 that is subsequently injected into the circuit at a secondary winding (e.g., injection point) 50 via the described act of inductive coupling. The injected signal is free of a DC component and is rich in harmonics, and there is not a need for a conversion circuit. In addition, in this embodiment, the injected signal is synchronized with the fundamental waveform (i.e., lamp lighting signal) of the inverter ballast circuit. The injection winding 50 also provides circuit isolation.

Thus, while it is appreciated that FIG. 2 shows the even harmonic signal injected on the secondary side (34*d*) of the output transformer 34 in FIG. 2 (i.e., the lamp connector side 36), the present application is also effective if the injection of the signal is on the primary side (34*c*) of the output transformer.

As previously discussed, FIG. 2 illustrates that the present concepts are suitable for current fed inverter ballasts, particularly for half-bridge ballast inverters. However, this is not intended to limit the present concepts to the circuit of FIG. 2, but rather the concepts may be used in other circuit control such as other current fed ballast circuits, including a push-pull current fed ballast inverter as well as voltage fed series resonant ballasts. The design is useful for high content Krypton mixture fluorescent lamps used in non-dimming or dimming applications.

Figure 6:
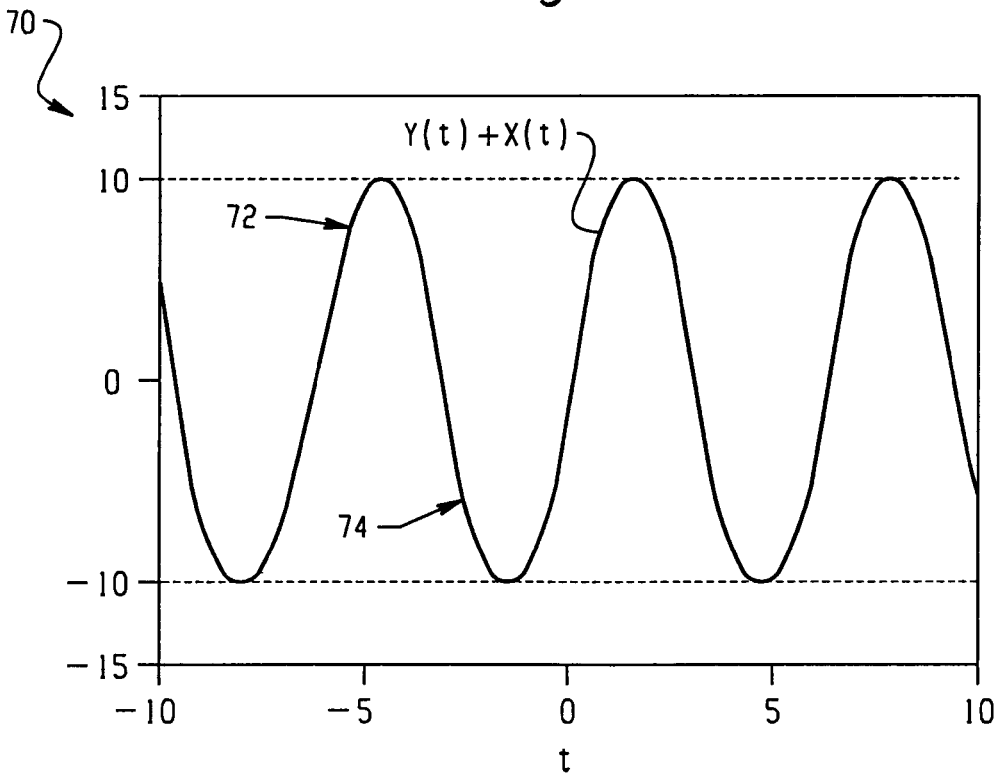
FIG. 6 shows the combination of the waveforms of FIG. 3 with FIG. 4 supplied to the lamp where the striation control signal and power are integrated.

Turning to FIGS. 3-6, the actions occurring by operation of circuit 20 of FIG. 2 are set forth in greater detail. Initially, in a circuit such as circuit 20 of FIG. 2 without the injected even harmonic signal and with switches 26 and 28 operating at approximately equal on and off times (i.e., a 50% duty cycle), a substantially sinusoidal lamp lighting signal 60, having no offset (i.e., the positive signal portions 62 are equal to the negative signal portions 64 of the signal 60) is developed. Striations may occur in these situations where there is high Krypton content and/or dimming of a circuit occurs. With further attention to operation of the present concepts, the even harmonic portions of a choke signal (also called the even harmonic signal) 66, generated by the current transformers 44, 46 and 48 is set forth in FIG. 4, and appears as something equivalent to a rectified AC output signal with signal portions 68*a*, 68*b* and 68*n* without a DC component. Choke signal 66 is injected (i.e., inductively coupled) at injection winding 50 to be part of the signal supplied to the lamps, as illustrated for example in FIG. 5. By adding the even harmonics signal 68*b* of choke signal 66 to the positive going signal portion 62 of signal 60 and adding signal portion 68*a* to the negative going portion 64 of signal 60, an offset lamp input signal 70 such as shown in FIG. 6 is generated. Offset lamp input signal 70 will have an increased positive portion 72 and a decreased negative portion 74 when compared to lamp lighting signal 60 of FIG. 3. Thus, where signal 60 of FIG. 3 supplied only odd harmonics to a lamp, harmonics signal 70 of FIG. 6 is designed with both even and odd harmonics. The input signal 70 of FIG. 6 is therefore provided to lamps to eliminate the discussed visual striations. It is to be appreciated choke signal 66 is synchronized with the fundamental signal 60 as they each are generated from the same input source. Therefore, in this design, synchronization is automatic due to the injected even harmonic signal 66 being generated by components in the same circuit, as the components generating the lamp lighting signal 60.

As described above, supplying the even harmonic signal generates an offset in the waveform of the lamp lighting signal being supplied to eliminate striations otherwise observed by the human eye. It will be appreciated that an odd harmonic signal would not be used as it would simply increase or decrease the lamp lighting signal in a equal amount, thereby not creating the desired offset.

Figure 7:
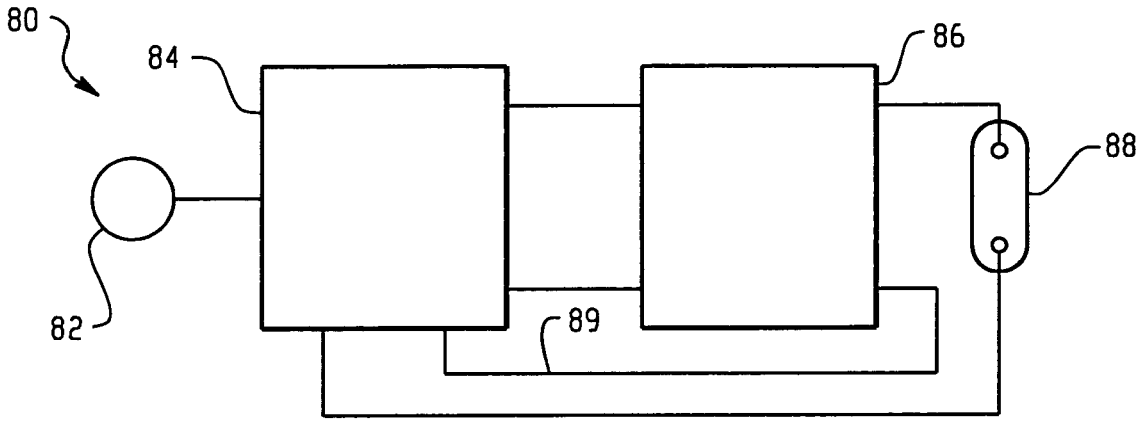
FIG. 7 illustrates a lamp lighting system where the even harmonic signal is derived from the power factor correction portion of the lamp lighting system.

Turning to FIG. 7, depicted are concepts of the present application employed in a lamp system 80, having an AC input 82, a power factor correction circuit 84, along with a ballast inverter 86, which supplies lamp 88. In this design the even harmonics are generated in the power factor correction circuit 84 and are injected into the ballast inverter circuit 86 via input line 89. In this design, the even harmonic signal supplied to the ballast inverter 86 results in a combination of an odd and even harmonics waveform of a lamp lighting signal (such as that shown in FIG. 6) to be supplied to lamp 88.

Figure 3:
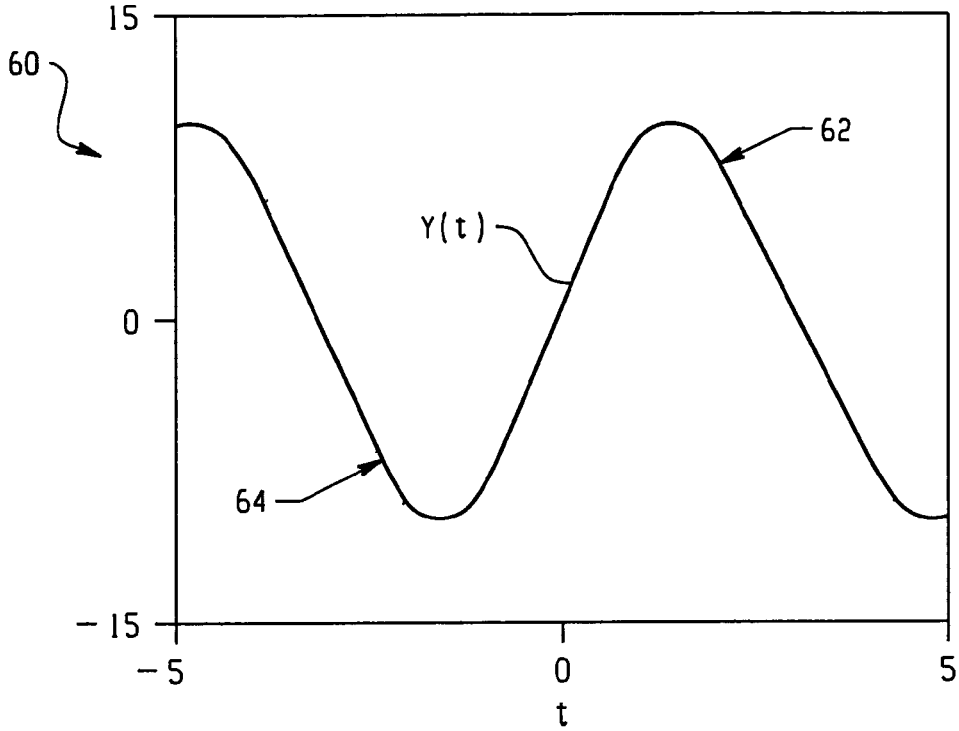
FIG. 3 depicts a harmonics free lamp lighting signal generated by the ballast system, without striation control.
Figure 4:
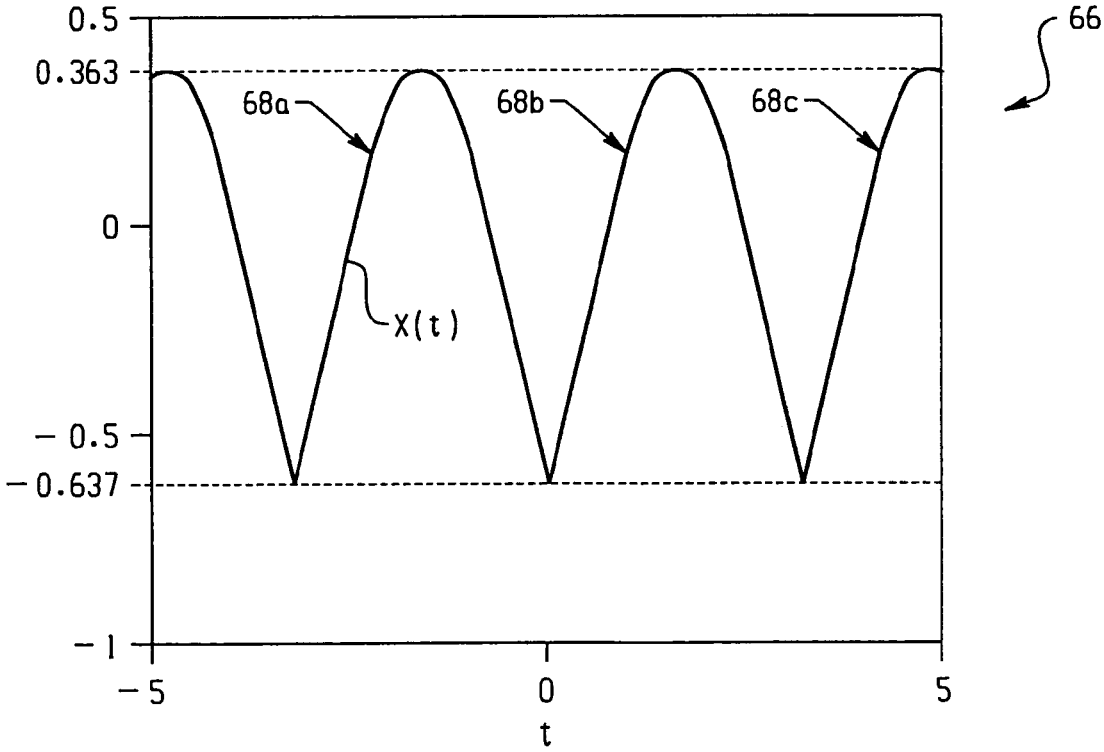
FIG. 4 sets forth a choke signal of a current fed inverter circuit such as in FIG. 2.
Figure 5:
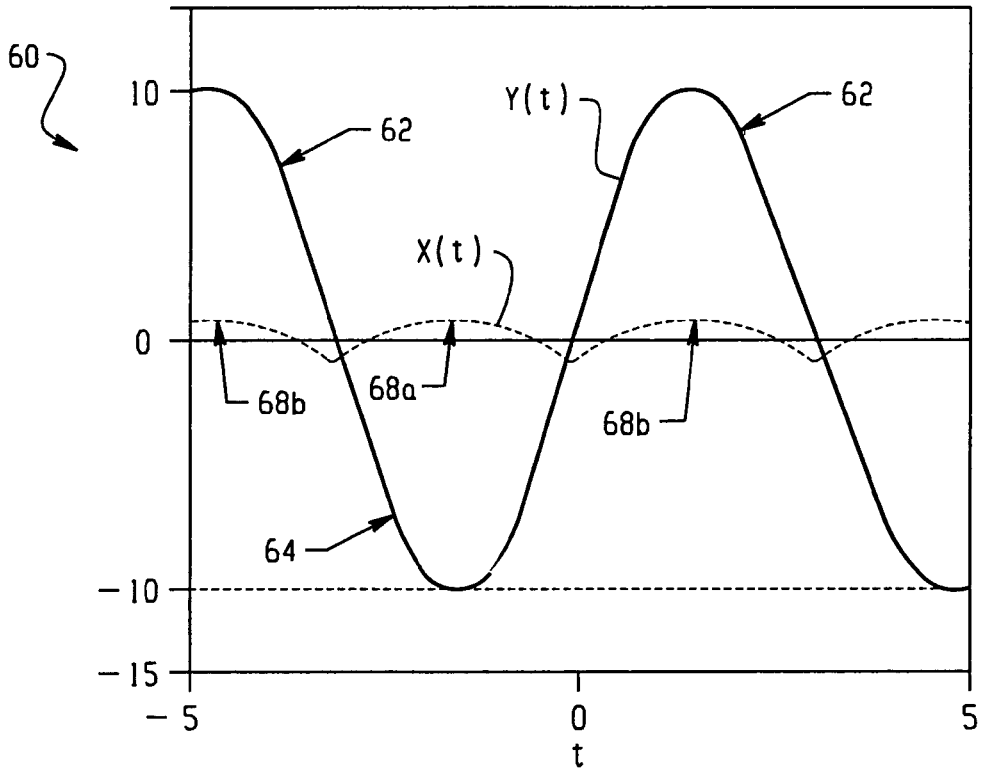
FIG. 5 depicts the waveform of FIG. 3 with portions of the choke waveform of FIG. 4.

The previous concepts described in connection with the circuit of FIG. 3, are equally applicable to the circuit of FIG. 7. For example, the even harmonic signal can be synchronized to the output signal to the lamp 88 by synchronizing Power Factor Circuit, 84 and inverter circuit 86. In this example, the ballast inverter may be the half-bridge inverter previously discussed, a push-pull inverter ballast or other lamp control circuit which is known in the art, including both other current fed as well as voltage fed control circuits.

Figure 8:
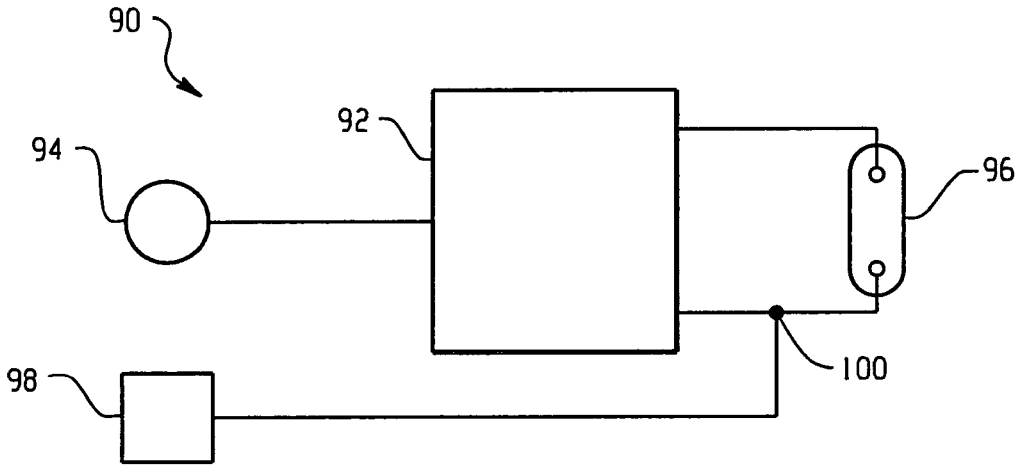
FIG. 8 provides another embodiment of a lamp lighting system where the even harmonic signal generator is separated from the lamp lighting circuit, where the even harmonic signal may be applied to the ballast generated lighting signal in a non-synchronized manner.
Figure 9:
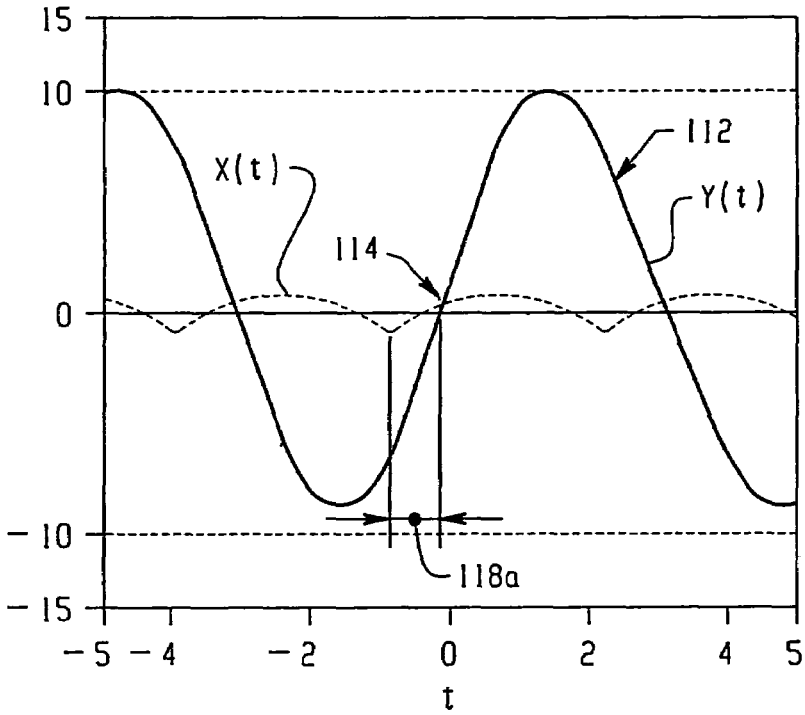
FIG. 9 depicts the even harmonic signal when it is not fully synchronized with the fundamental ballast lamp lighting signal.

Turning to FIG. 8, illustrated is a lamp lighting circuit 90 where ballast 92 receives power from power source 94 for application to lamp 96. In this design, an even harmonic signal generator 98 is provided separately from the ballast 92 and power source 94 and is injected into the ballast generated signal at injection winding or point 100. By this arrangement, and as shown in FIG. 9, the even harmonic signal 114 is not fully synchronized with the fundamental ballast lamp lighting signal 112. In some situations this circuit may be used when it is desirable to alter the synchronization between the even harmonic signal 114 and the lamp lighting signal 112. This may be accomplished by selecting a set time difference between the generation of the even harmonic 114 and the fundamental ballast lamp lighting signal 112. Alternatively, in one embodiment, even harmonic generator 98 is a variable signal generator, wherein the variability is the timing of the generation of the even harmonic signal compared to the generation of the lamp lighting signal. For both situations, and as shown in FIG. 9, ballast lamp lighting signal 112 is the normally generated symmetric signal created when the switching network is at a 50% duty cycle. Then by use of even harmonic generator 98 of FIG. 8, an even harmonic signal 114 is generated which is not synchronized with the lamp lighting signal 112.

Figure 10:
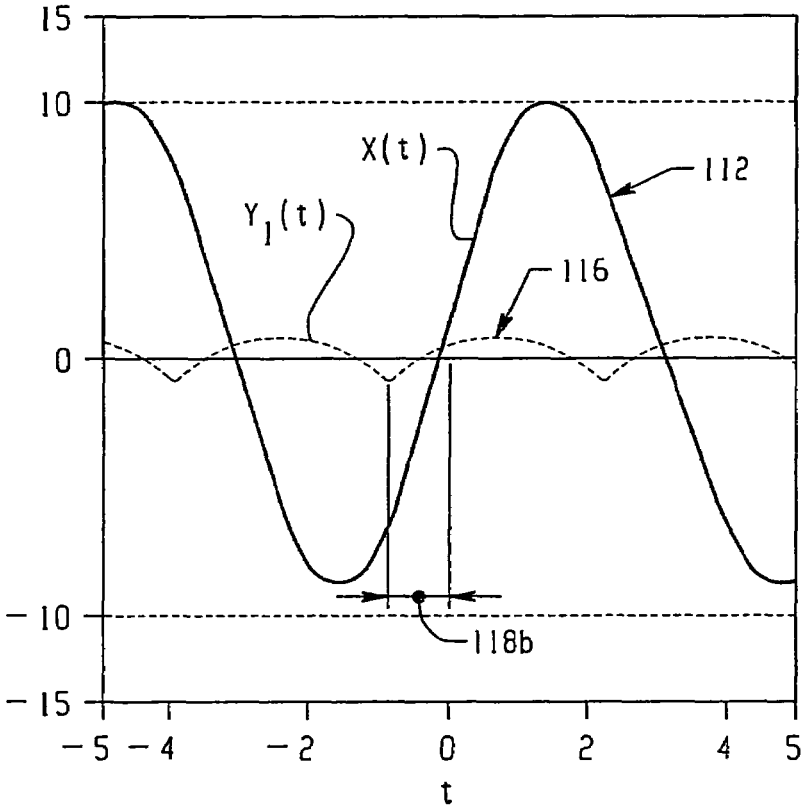
FIG. 10 depicts the concept of the even harmonic generator of FIG. 8 being a variable generator wherein the degree of non-synchronization between the even harmonic signal and the lamp lighting signal created by the ballast is variable.

Turning to FIG. 10, as can be seen in comparison of FIG. 9, the even harmonic signal 116 is generated at a time different from that of lamp lighting signal 112 of FIG. 9. Thus, as can be seen, the even harmonic generator 98 of FIG. 8 can be considered variable in its generation of the even harmonic signal. By this design, a variable phase difference (i.e., 118*a* of FIG. 9 and 118*b* of FIG. 10) may be provided between the ballast generated lamp lighting signal and the even harmonic signal. This variable feature permits selective control of the amount of offset created in the waveform of the lamp lighting signal.

Figure 11:
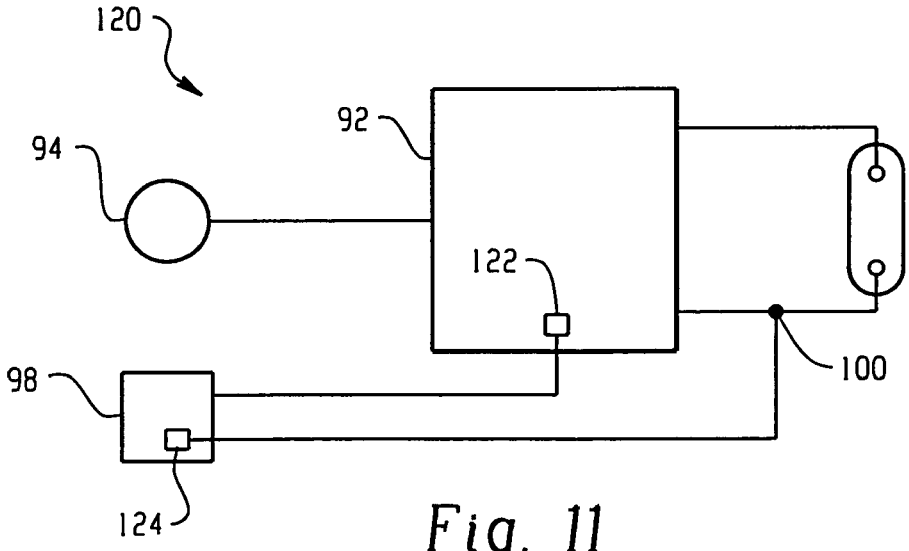
FIG. 11 depicts a further embodiment of a lamp lighting system wherein a ballast lighting signal sensor is incorporated into the ballast circuit to sense the value of the lighting signal, and this sensed value is then used by the variable harmonic generator which alters the value of the even harmonic signal.

Additionally, in another embodiment shown in FIG. 11, circuit 120 is designed to include a ballast output sensor 122 which senses the value of the signal being generated by ballast 92. The output of sensor 122 is supplied to a variable harmonic generator 98, which may automatically adjust the value of the even harmonic signal generated by the even harmonic signal generator 98. It is to be appreciated the output sensor 122 may be any appropriate sensor which will sense a known output parameter of the lamp output signal of the ballast, such as but not limited to a voltage and/or current sensor.

Additionally, variable harmonic generator 98 may provide its variability by use of a control circuit 124. For example, in one embodiment control circuit 124 is designed as a known signal delay circuit positioned on the primary side 34*c* or secondary side of ballast 20. The amount of delay being dependant on the value of the ballast output signal.

Figure 12:
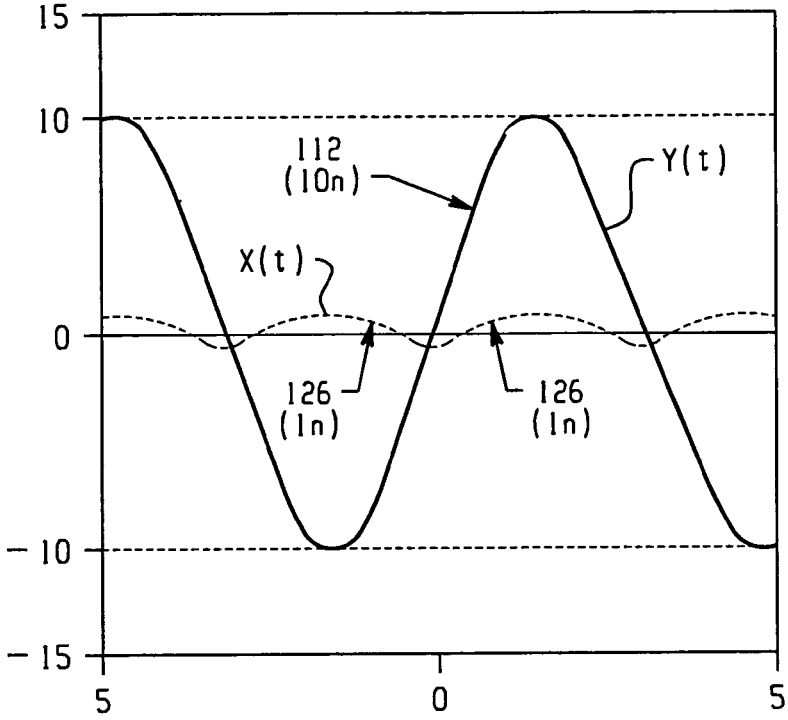
FIGS. 12 and 13 show the value variability of the even harmonic generator of FIG. 11.
Figure 13:
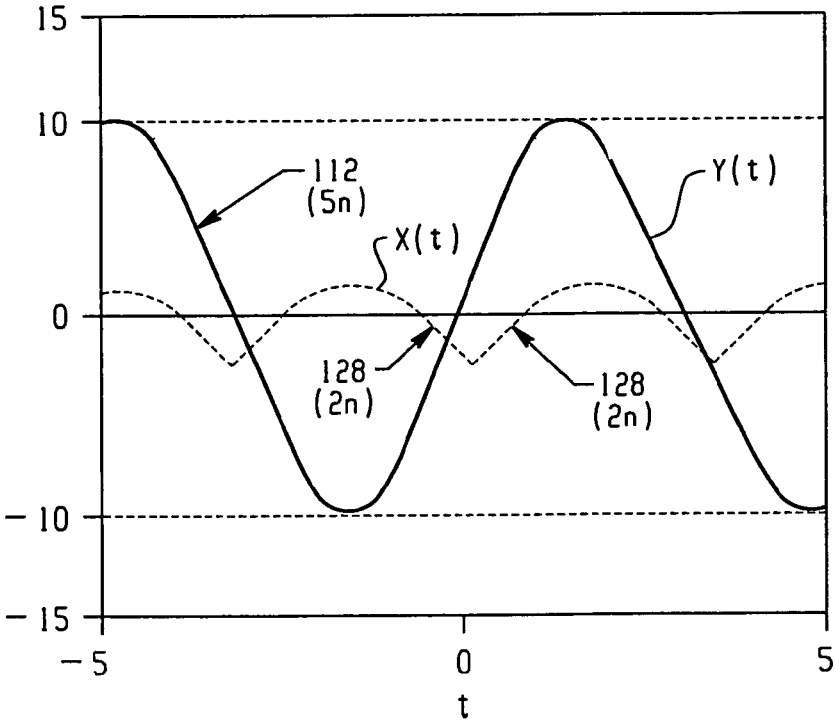

In this embodiment, even harmonic generator 98 will increase (or decrease) the value of the even harmonic signal as the ballast output signal is decreased (or increased), whereby the value of the even harmonic signal is inversely proportional to the ballast lamp lighting signal. This operational concept is illustrated in FIGS. 12 and 13. For example, when the ballast supply signal is a 10n signal, the even harmonic signal 126 may be a 1n signal. Then as shown in FIG. 13, when the ballast supply signal 112 is sensed to have been lowered (i.e., dimmed) to 5n, the even harmonic signal is increased to 2n.

This arrangement is beneficial to increasing the life of the lamp, since when the lamp is operating at 100% (e.g., the ballast signal 10n is the non-dimming 100% ouput) and the formation of visual striations is less likely, a smaller even harmonic signal 126 may be applied, creating less stress (i.e. lower lamp current crest factor) on the lamp. However, when a dimming occurs (e.g., when the output signal from the ballast is at 5n, showing a dimming operation), the even harmonic signal 128 may be increased (i.e., increased to 2n), in order to eliminate striations which could otherwise occur due to dimming operations. Thus, by having this variable capability, when striations are not found to occur, less stress are put on the lamp, thereby increasing its life expectancy.

The present disclosure discusses the use of the fundamental waveform as the source of the even harmonic signal to be combined with the lamp lighting signal. Of course, there are other sources where the signal to be combined with the lamp lighting signal may be obtained, and it is to be understood it is possible to use a signal other than the even harmonics signal. Also, while the primary manner of combining the signals is described as inductive coupling, the signals can be combined by other well-known signal merging techniques.

The even harmonic generator of FIG. 8 and the even harmonic generator of FIG. 11 can be formed as a single unit, whereby the variability both in the timing of the generation of the signal (i.e., FIG. 8) and the value of the even harmonic signal (e.g., FIG. 11) are combined in a single even harmonic signal generator. The described signal generators can be formed using known technology and therefore do not need to be discussed in greater detail.

The described concepts may be employed in dimming and non-dimming situations and is not limited to a current fed circuit. Also, while a BJT switching mechanism was shown in FIG. 2, it is to be appreciated that a system may employ FET switches in the inverter ballast. As previously noted, the present concepts may be implemented in numerous forms.

In the foregoing embodiment of FIG. 2, component designations and/or values for the circuit of FIG. 3 would include:

| | |
|---|---|
| Transistor 26 | BUL1102E |
| Transistor 28 | BUL1102E |
| Zener Diode 30a | 68 V |
| Capacitor 30b | 0.22 uf |
| Diode 30c | UF4007 |
| Diac 30d | 32 V |
| Diode 30e | 1N5817 |
| Resistor 30g | 150Ω |
| Resistor 30h | 150Ω |
| Diode 30i | UF4007 |
| Diode 32a | UF4007 |
| Resistor 32f | 150Ω |
| Resistor 32g | 150Ω |
| Diode 32h | UF4007 |
| Zener Diode 38a | 300 V |
| Zener Diode 38b | 300 V |
| Zener Diode 38c | 300 V |
| Capacitor 40 | 1.2 nf |
| Windings 44 | 40 mh |
| Windings 46 | 40 mh |
| Windings 48 | 80 mh |
| Windings 50 | 7 mh |

Again, while the present application may be used in a variety of circuits and embodiments, one such use is for instant program start ballasts in a family of current fed electronic ballasts, for example in the 4' T8 electronic design of General Electric. It is also shown in FIG. 2, that there is no use of an unbalanced BJT drive winding or impedance in the base drive for the BJT.

Although the present concepts are described primarily in connection with fluorescent lamps, the circuit herein described may be used to control any type of gas discharge lamp.

The concepts have been described with reference to the exemplary embodiments. Obviously, modifications and alterations will occur to others upon reading and understanding the preceding detailed description. It is intended that the described concepts be construed as including all such modifications and alterations.

What is claimed is:

1. In a ballast which generates a lamp lighting signal for a discharge lamp or lamps, a striation elimination circuit for elimination of visual striations, the striation elimination circuit comprising:

an even harmonic signal generator configured to generate an even harmonic signal; and an injection point configured for the combination of the even harmonic signal and the lamp lighting signal, the injection point located at a position wherein the even harmonic signal alters a lamp lighting lumen output frequency.

2. The striation elimination circuit according to claim 1, wherein the even harmonic signal generator is incorporated in the ballast circuit.

3. The striation elimination circuit according to claim 1, wherein the even harmonic signal is synchronized to the lamp lighting signal.

4. The striation elimination circuit according to claim 1, wherein the even harmonic signal generator is separate from the ballast circuit.

5. The striation elimination circuit according to claim 1, wherein the ballast includes a current fed inverter circuit.

6. The striation elimination circuit according to claim 1, wherein the even harmonic signal is injected into a secondary of an output transformer.

7. The striation elimination circuit according to claim 1, wherein the even harmonic signal is injected to a primary of an output transformer.

8. The striation elimination circuit according to claim 1, wherein the even harmonic signal generator is a variable even harmonic signal generator variability being one of timing of the generation of the even harmonic signal.

9. The striation elimination circuit according to claim 1, wherein the even harmonic signal is injected via the use of transformer windings.

10. The striation elimination circuit ballast according to claim 1, wherein the lamp has a Krypton content in a range of approximately 40% to 75%.

11. The striation elimination circuit according to claim 1, wherein the lamp has a Krypton content greater than 75%.

12. The striation elimination circuit of claim 1, wherein the lamp lighting signal and the even harmonic signal are generated separately from each other and are separate signals, prior to being combined.

13. The striation elimination circuit as set forth in claim 1, wherein the gas discharge lamp is a fluorescent lamp.

14. A method of supplying signals to a gas discharge lamp in a lamp lighting system which eliminates visual striations from appearing in the lamp, the method comprising:

generating a lamp lighting signal;

generating an even harmonic signal;

combining the lamp lighting signal and the even harmonic signal;

supplying the combined lamp lighting signal and the even harmonic signal to the gas discharge lamp; and synchronizing the even harmonic signal with the lamp lighting signal.

15. The method according to claim 14, further including generating the even harmonic signal is out of synchronization with the lamp lighting signal.

16. The method according to claim 14, wherein the even harmonic signal is supplied in an inverse proportion to the supplied lamp lighting signal.

17. The method according to claim 14, wherein the even harmonic signal is independent from the ballast circuit.

18. A control circuit for providing electrical power from a source to a gas discharge lamp, comprising:

a ballast circuit for providing AC current to electrodes of the gas discharge lamp to generate a lamp lighting signal and maintain an electric discharge therethrough; and an even harmonic signal generator for generating a signal that is synchronized with the lamp lighting signal, the even harmonic signal comprising an even harmonic of the AC current and providing the even harmonic signal to the electrodes of the lamp simultaneously with the ac current, wherein a shifted waveform is provided to the lamp electrodes for substantially eliminating visible striations.

19. The control circuit according to claim 18, wherein the ballast includes a half-bridge inverter.

20. The control circuit according to claim 18, wherein the ballast includes a push-pull circuit.

21. The control circuit according to claim 18, wherein the ballast circuit uses BJT switches.

* * * * *